US012723357B2

(12) United States Patent
Mikowychok

(10) Patent No.: US 12,723,357 B2
(45) Date of Patent: Sep. 1, 2026

(54) VIBRATOR MECHANISM USABLE WITH A CONCRETE FINISHING TOOL

(71) Applicant: Frank Mikowychok, Lincoln, CA (US)

(72) Inventor: Frank Mikowychok, Lincoln, CA (US)

( * ) Notice: Subject to any disclaimer, the term of this patent is extended or adjusted under 35 U.S.C. 154(b) by 317 days.

(21) Appl. No.: 18/671,323

(22) Filed: May 22, 2024

(65) Prior Publication Data

US 2024/0410120 A1 Dec. 12, 2024

Related U.S. Application Data

(63) Continuation-in-part of application No. 18/208,665, filed on Jun. 12, 2023, now Pat. No. 12,606,966.

(51) Int. Cl.
*E01C 19/40* (2006.01)

(52) U.S. Cl.
CPC ..... *E01C 19/402* (2013.01)

(58) Field of Classification Search
CPC ..... E01C 19/402
USPC ..... 404/97, 113
See application file for complete search history.

(56) References Cited

U.S. PATENT DOCUMENTS

| | | | |
|---|---|---|---|
| 2,740,336 | A | 4/1956 | Degen |
| 2,989,869 | A | 6/1961 | Hanggi |
| 3,188,054 | A | 6/1965 | Mason |
| 3,237,896 | A | 3/1966 | Peterson |
| 4,431,336 | A | 2/1984 | Nightengale |
| 5,234,283 | A | 8/1993 | Adkins |
| 5,632,569 | A | 5/1997 | Szmansky |
| 5,796,188 | A | 8/1998 | Bays |
| 6,057,608 | A | 5/2000 | Bailey et al. |
| 6,139,217 | A | 10/2000 | Reuter |
| 6,231,331 | B1 | 5/2001 | Lievers |
| 6,374,569 | B1 | 4/2002 | Suckow |
| 6,976,909 | B1 | 12/2005 | Hoover |
| 6,988,851 | B2 | 1/2006 | Sina |
| 7,097,384 | B2 | 8/2006 | Lindley |
| 7,160,132 | B2 | 1/2007 | Phillips et al. |
| 7,465,121 | B1 | 12/2008 | Hendricks et al. |
| 8,230,760 | B1 | 7/2012 | Breeding |
| 8,262,440 | B2 | 9/2012 | Krompack |
| 9,139,966 | B1 | 9/2015 | Mikowychok |
| 9,276,438 | B2 | 3/2016 | Grant et al. |
| 9,397,531 | B2 | 7/2016 | Mikowychok |

(Continued)

*Primary Examiner* — Raymond W Addie
(74) *Attorney, Agent, or Firm* — Annmarie W Whitley; Whitley Legal Group, PC

(57) ABSTRACT

A vibration mechanism for a concrete finishing tool includes adapters for removable attachment to the tool and a device housing with a general chamber supporting a battery electrically connected to a vibrator assembly, which includes a vibrator housing with a plurality of perimeter vents that slow heat transfer and direct heat away from other components. Vibrator assembly components positioned in vibrator housing are a rotor with a rotor shaft and weighted body, a bearing supporting the rotor, a motor with an output shaft, a combination spacer with a resilient spacer band and a micro motor shaft seal positioned adjacent the motor and around the motor output shaft, and a resilient link between the rotor shaft and the motor output shaft. A resilient vibrator band around the vibrator housing transfers vibrations to the device housing and together with the combination spacer minimizes fluid leakage within the vibrator assembly and device housing.

20 Claims, 10 Drawing Sheets

(56) References Cited

U.S. PATENT DOCUMENTS

| | | | | |
|---|---|---|---|---|
| 9,419,466 | B2 | 8/2016 | Pickens et al. | |
| 9,719,215 | B2 | 8/2017 | Mikowychok | |
| 10,184,217 | B2 | 1/2019 | Mikowychok | |
| 10,326,331 | B2 | 6/2019 | Mikowychok | |
| 10,968,574 | B2 | 4/2021 | Mikowychok | |
| 12,606,966 | B2 * | 4/2026 | Mikowychok | E01C 19/38 |
| 2005/0036837 | A1 | 2/2005 | Marshall | |
| 2008/0050177 | A1 | 2/2008 | Sager | |
| 2012/0183351 | A1 | 7/2012 | Brening | |
| 2013/0223929 | A1 | 8/2013 | Stephens | |
| 2015/0022040 | A1 | 1/2015 | Mikowychok | |
| 2015/0357880 | A1 * | 12/2015 | Mikowychok | E04G 21/066 310/81 |
| 2016/0319497 | A1 * | 11/2016 | Mikowychok | E04F 21/242 |
| 2017/0292229 | A1 * | 10/2017 | Mikowychok | E04F 21/242 |
| 2018/0278121 | A1 * | 9/2018 | Mikowychok | H02K 7/061 |
| 2023/0102567 | A1 | 3/2023 | Mikowychok | |

* cited by examiner

VIBRATOR MECHANISM USABLE WITH A CONCRETE FINISHING TOOL

FIELD OF THE INVENTION

The present invention relates to a novel and useful improvements for a vibration departing device for a concrete finishing tool.

BACKGROUND OF THE INVENTION

Concrete finishing tools, such as floats, jointers, screeds and the like, are used to provide a particular finished surface adjusted to a freshly poured concrete mass. In the conventional method of use of such concrete finishing tools, an operator moves the tool across the surface of the freshly poured concrete, usually in a back and forth manner, before the concrete mass cures or dries.

It has also been recognized that the addition of a vibratory action to the concrete finishing tool aids in the creation of a surface, characteristic, such as a smooth surface and in the case of a jointer, possesses a groove to control cracking of the finish concrete slab.

In the past, various tools have been proposed to provide a vibration motion to concrete finishing tools. For example, U.S. Pat. Nos. 6,231,331, 6,988,851, 7,097,384, and 8,230,760 show concrete vibrating devices in which an external motor is mounted to a handle or shaft and linked to a remote vibration mechanism by the use of a cable or gear mechanism. U.S. Pat. No. 6,139,217 shows a concrete finishing tool in which a power source is placed within the handle of the concrete finishing tool and provides power to vibrators that are located atop of the head of the finishing tool adjacent the concrete. U.S. Pat. Nos. 5,632,569 and 7,465,121 show handheld cement and concrete finishing tools in which a vibrator is placed within the handle structure of the tools and powered by a battery that is also found in the handle. These tools, however, do not show a method for controlling the vibration within the handle, other than by control of electrical power to the vibrating mechanism.

U.S. Pat. Nos. 9,139,966, 9,397,531, 9,719,215, and 10,184,217, which are incorporated herein by reference, illustrate a handheld finishing tool with a vibrator placed within the handle with improved vibration control. While these tools address the handle vibration concerns, to improve performance and extend their operational life, these finishing tools would further benefit from additional features that limit oil leakage from the bearing mechanism. These tools would also benefit from additional features that minimize overheating.

A vibration imparting device for a concrete finishing tool that is self-contained and positionable between the handle and terminus of the concrete finishing tool, allows for optimum vibration of the vibrating mechanism, minimizes oil leakage, and minimizes overheating risks would be a notable advance in the construction arts.

SUMMARY OF THE INVENTION

In accordance with the present invention a novel and useful vibration imparting device for a concrete finishing tool is herein provided.

The device of the present invention includes a device housing with a general chamber formed by its inner surface. The housing is sized to accommodate a vibrator assembly, battery, and components to connect the vibrator assembly and battery including switches, optional wireless receivers, and optional variable speed controllers. The battery is preferably held within device housing by one or more spacers, which further serve to protect the battery and dampen vibrations near the battery. Optionally, a removable external battery can be secured to the outer surface of the device housing. The battery provides electrical power to the vibrator assembly, and the vibrator assembly can be selectively and variably powered by the battery with a switch or knob physically present on the device or optionally by remote control.

The vibrator assembly, positioned within the general chamber of the housing, includes a resilient vibrator band that surrounds and contacts the vibrator assembly and the device housing inner wall. The resilient vibrator band forms a spaced relationship between the vibrator and the housing inner surface within the general chamber, transfers vibrations to the device housing and concrete finishing tool when attached, and acts as a seal to prevent oil from entering the portion of the vibrator assembly that houses the motor. Preferably, one or more anchors are also present to further secure the vibrator assembly within the general chamber at the same spaced relationship as that created by the resilient vibrator band secured between the housing inner surface and the vibrator.

The device housing cooperates with first and second adaptors that removably connect the device housing to the handle and terminus, respectively, of the concrete finishing tool.

The vibrator assembly preferably includes an improved vibrator housing, a rotor with an attached weighted body, a roller bearing fit between the rotor and the vibrator housing, and a rotor shaft extending into rotor along its central axis such that when the rotor shaft turns, the rotor and weighted body turn. Vibrator assembly addition includes a motor, a combination spacer, and a motor output shaft controlled by the motor and disposed through the combination spacer. A resilient link, which is preferably a coupler, connects the rotor shaft and the motor output shaft such that when the motor output shaft rotates, the rotor shaft and thereby the rotor and weighted body also rotate. Rotation of the rotor and weighted body creates vibrations.

To minimize or prevent oil from leaking from the roller bearing area into the motor area of the vibrator assembly, several features work together. First, combination spacer acts as a physical barrier between the area of the vibrator housing where the resilient link is housed and the area of the vibrator housing where the motor is housed. Combination spacer is a plate configured and sized to fit over the nose end of the motor. Combination spacer further includes a resilient spacer band surrounding its outer wall or perimeter, which forms a seal between combination spacer and the vibrator housing to minimize or prevent oil from passing around the combination spacer along the vibrator housing inner surface and toward the motor. Combination spacer also includes a micro motor shaft seal, which is positioned around the output shaft of the motor in a pocket of the plate. The micro motor shaft seal minimizes or prevents oil from leaking around the motor output shaft into the motor to prevent contamination of its electrical parts.

The vibrator housing also includes features to reduce the likelihood of oil contaminating the area around the motor. A series of openings is defined by the vibrator housing near where the resilient link and roller bearing are housed. The series of openings extend from the outer surface of the vibrator housing to the inner surface to create a path for oil to escape from the inner chambers of the vibrator housing to the general chamber of the device housing. Near the series of openings at a position roughly aligned between the vibrator housing chamber that holds the resilient link and the vibrator housing chamber that holds the motor, preferably an annular groove surrounds the outer surface or perimeter of the vibrator housing. The annular groove is configured to hold the resilient vibrator band that forms the spaced relationship between the device housing and the vibrator assembly. The resilient vibrator band thereby further minimizes prevents oil from entering the portion of the device housing where the vibrator assembly's motor is positioned.

To reduce overheating, the vibrator assembly housing includes heat reducing features including the series of openings discussed above, which slow the transfer of heat between the motor and the rotor and bearing components of the vibrator assembly. Additionally, vibrator housing assembly, which is also known as a thermal decoupler housing, extends along a majority of the length of the motor and optionally the entire length of the motor. Located between the area of the vibrator housing where the resilient vibrator band and annular groove are located and the end of the housing near the motor, in a first embodiment, are several annular fins and grooves. The fins and grooves create more surface area from which heat can be further dispersed. With a second and preferred embodiment of the vibrator housing, a series of perimeter vents are defined by the vibrator housing about the perimeter of the housing in place of the fins and grooves. The additional length of the vibrator assembly also presents additional space through which additional fasteners can be positioned for holding the motor within the vibrator housing.

To operate the improved vibrator mechanism, an operator inserts the device between the handle and terminus of a concrete finishing tool. Once properly installed, the operator activates the motor and, when available, selects the motor speed. The operator can then move the concrete finishing tool along the surface of soft concrete to create a particular finish on the surface. For example, if the finishing tool is a float, the vibrations from the improved vibration mechanism create a smooth surface. When the operator wishes to pause or finish working with concrete finishing tool, the operator deactivates the motor.

For a better understanding of the invention reference is made to the following detailed description of the preferred embodiments of the invention which should be taken in conjunction with the above described drawings.

DETAILED DESCRIPTION OF THE INVENTION

Various aspects of the present invention will evolve from the following detailed description of the preferred embodiments thereof which should be referenced to the prior described drawings.

Figure 1:
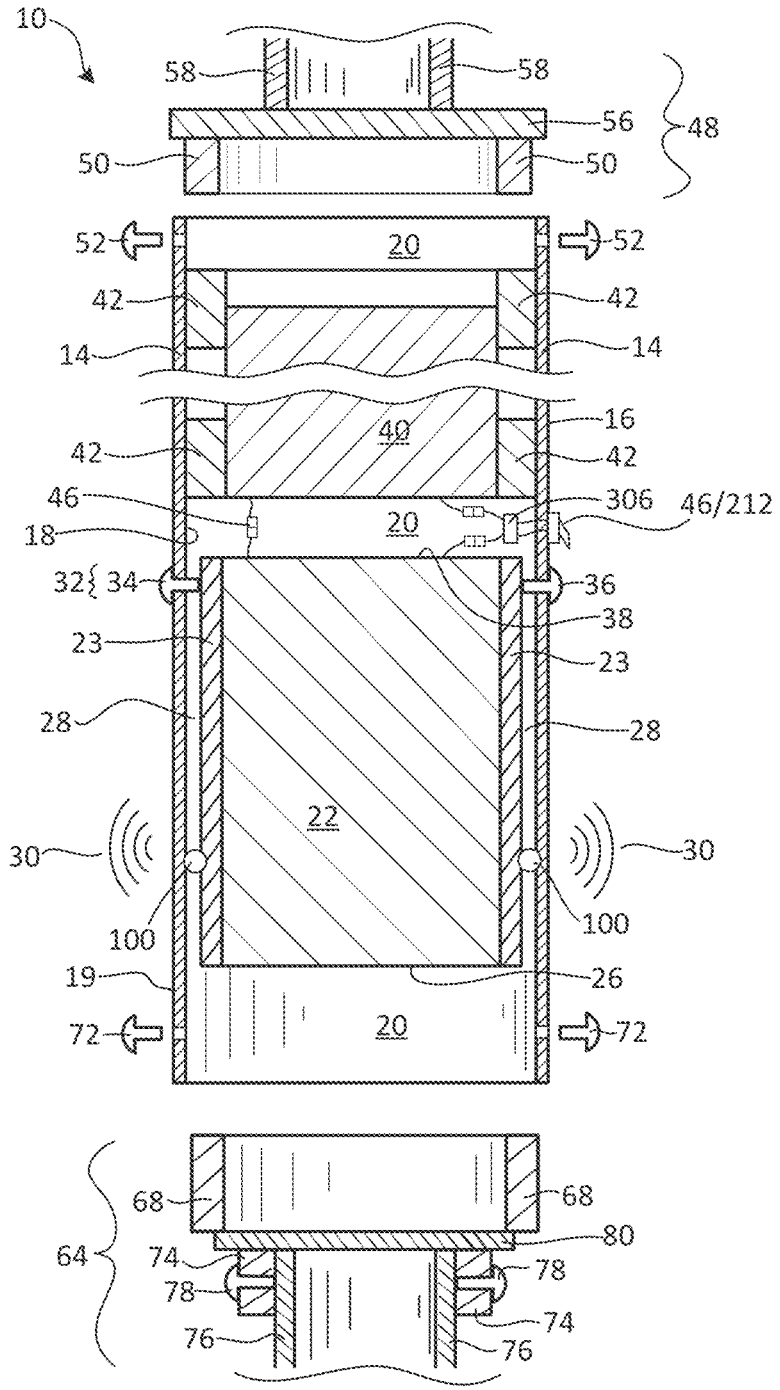
FIG. 1 is a partially exploded and broken sectional view of the improved vibrator mechanism of the present invention as positioned between the handle and the terminus of a concrete finishing tool.
Figure 2:
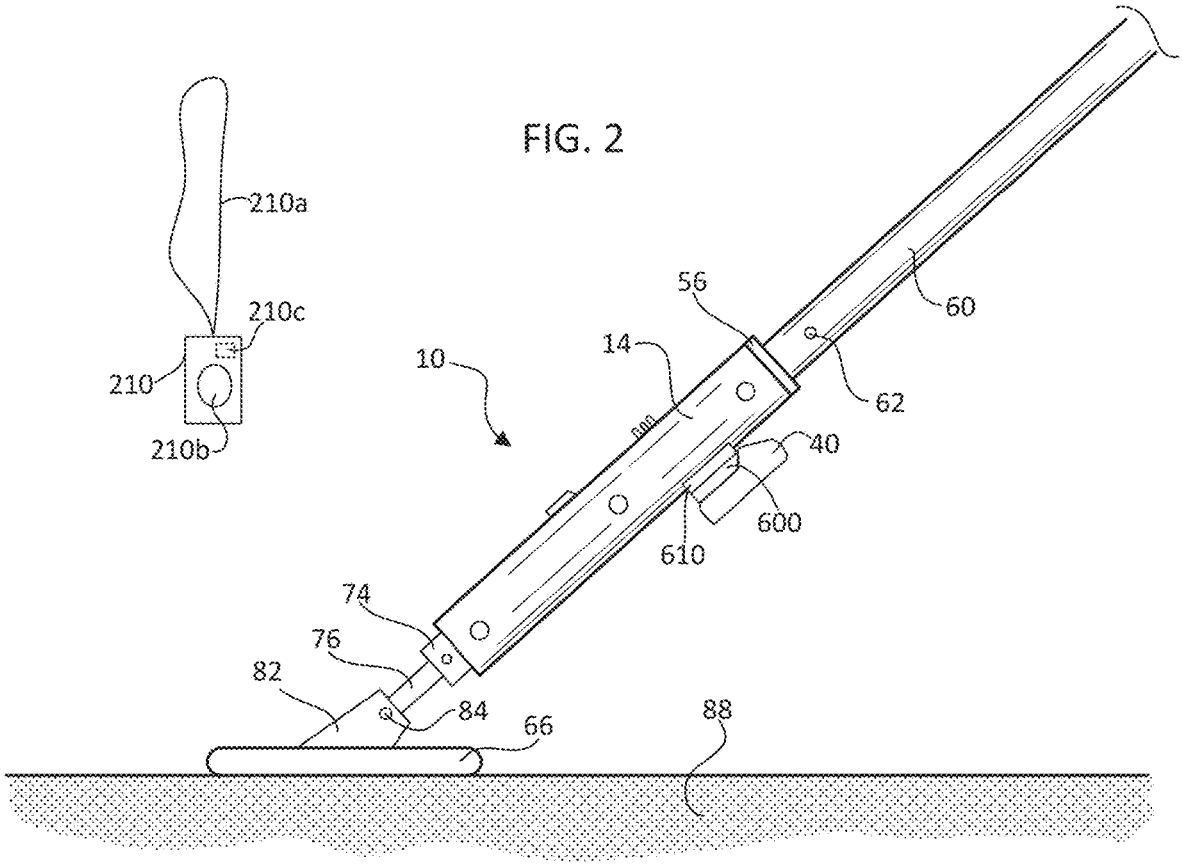
FIG. 2 is a side partial elevational view of a concrete finishing tool with improved vibrator mechanism of the present invention installed therein with a remote activation device.

The vibrator mechanism device 10 of the present invention imparts vibration to concrete finishing tools such as the concrete finishing tool 12 shown in FIG. 2. Device 10 includes a device housing 14 that preferably takes the form of a cylindrical tube, as shown in FIGS. 1-2. Device housing 14 can be formed of any rigid or semi-rigid material, such as metal, plastic, wood, and the like. For example, aluminum tubing suffices in the construction of device housing 14. Device housing 14 is preferably sized to accommodate installation in or cooperation with existing concrete finishing tools, which is discussed in greater detail below.

Device housing 14 is further sized and configured to house or support several cooperating components including a vibrator assembly 22 and battery 40. In the preferred embodiment, vibrator assembly 22 and battery 40 are housed entirely within a general chamber 20 formed in part by the inner surface 18 of device housing 14 and arranged as shown in FIG. 1. Optionally, a battery receptacle 600 is secured to the outside surface 19 of the device housing 14 via a bracket 610 to accommodate an external removable battery 40. In some embodiments, vibrator assembly 22 is supported within general chamber 20 by a resilient vibrator band 100 or collar that extends around vibrator assembly 22 at a first end 26 of vibrator assembly 22. Band 100 is preferably and "O" ring, and more preferably, band 100 has an inside diameter of 0.125 inches and a thickness of ⅛ inch. Band 100 or collars may be constructed of rubber, plastic, or other like material. Band 100 forms a space 28 between inner surface 18 of device housing 14 and vibrator assembly 22 and further serves to transmit vibrations from vibration assembly 22 to device housing 14 and the terminus of the concrete finishing tool 12. Vibrations are represented with vibration lines 30 on FIG. 1. Vibrator assembly 22 further optionally includes an outer sheath 23, preferably made of plastic, that directly contacts ring 100.

Vibrator assembly 22 is optionally and preferably secured within device housing 14 by one or more anchors 32, preferably positioned near a second end 38 of vibrator assembly 22. Anchors 32 can be set screws, spacers, or any other component that maintains the establishment of space 28 between vibrator assembly 22 and device housing 14. As shown in FIG. 1, anchors 32 are set screws that extend through housing 14 and bear against second end 38 of vibrator assembly 22. Anchors 32 are useful to bias vibrator assembly 22 against movement at its second end 38 and in favor of movement at its first end 26, which is nearest to the concrete finishing tool terminus 66. Anchors 32 and band 100 work together to prevent vibrator assembly 22 from directly contacting the inner surface 18 of device housing 14 as such contact would greatly impede the imparting of vibration to finishing tool 12. Additional components of vibrator assembly 22 are shown in FIGS. 3-16 and will be discussed in greater detail below.

Figure 16:
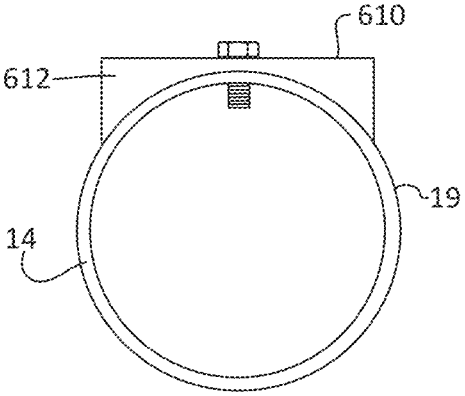
FIG. 16 is an end view of the adapter plate shown in FIGS. 14 and 15 attached to the device housing shown of FIG. 13.

Device housing 14 preferably also houses within its general chamber 20 a rechargeable or replaceable battery 40 as shown in FIG. 1 or an external battery optionally removably secured to the outer surface of device housing 14 with a battery receptacle 600 and bracket 610 as shown in FIGS. 2 and 13A-16. Battery 40 may take the form of a 14.4 volt NiCAD, 12 cell, 4,000 MAH battery or a DeWalt brand 20 volt battery, a Milwaukee brand 18 volt battery, or a Makita brand 18 volt battery. If housed within general chamber 20, battery 40 is preferably positioned or fixed within the general chamber 20 of device housing 14 such that it does not move. For example, battery 40 can be held in place due to friction with one or more spacers 42 mounted around the outer surface (not labelled) and preferably near the ends (not labelled) of battery 14 as shown in FIG. 1. Consequently, battery 14 fits snuggly within general chamber 20 of device housing 14. Optionally, additional fasteners or screws (not shown) may be passed through device housing 14 to engage spacers 42 to prevent slippage of electrical battery 40 within general chamber 20.

Where device housing 14 cooperates with a battery receptacle 600 for an externally mounted battery 40, an adapter bracket 610 preferably attaches to the outer surface 19 of the device housing 14 to create a flat mounting surface, as shown in FIGS. 2 and 16. Preferably bracket 610 accepts rail-style batteries such as the own shown in FIG. 13A, and FIGS. 13B-16 illustrate an exemplary adapter bracket 610 for connecting to a curved surface. Adapter bracket 610 includes a mounting surface 602, a housing surface 604, and openings 606*a* and 606*b* for fasteners and wires as will be known to those skilled in the art. Preferably, openings 606*a* and 606*b* extend through both the mounting surface 602 and housing surface 604 respectively to create a channel or are aligned to create a pathway to accept fasteners. Openings 606*a* and 606*b* also are positioned to cooperate with openings 620*a* on a device housing 14 when adapter plate 610 is positioned as desired for attaching it to device housing 14. More preferably, openings are sized to accept either fasteners or leads to allow adapter 610 to accommodate a variety of battery receptacle 600 embodiments. Adapter 610 housing surface 604 mirrors the device housing 14 to which it will attach, and mounting surface 602 receives battery receptacle 600. Connecting the mounting surface 602 to the housing surface 604 are one or more adapter side walls 612 and 612. Mounting surface 602 also preferably defines openings 608 for receiving the fasteners required to attach battery receptacle 600 to adapter bracket 610. Housing surface 604 may support gaskets or seals such as the O-rings that enhance and protect the components when battery receptacle 600 and adapter plate 610 are attached to a device housing 14. Additional details about a bracket 610, receptacle 600, and external batteries suitable for use with device housing 14 are described and illustrated in U.S. Pat. Publ. 2023/0102567, which is incorporated herein by reference.

An electrical switch 44 and conventional connectors 46 electrically connect battery 40 to vibrator assembly 22 and permit the selective activation of vibrator assembly 22 from the exterior of housing 14. Switch 44 can be a rotating knob, toggle, button, slider, or another type of switch as is known to those skilled in the art. Preferably, switch 44 is a wirelessly operated switch 212 that wirelessly communicates with an activation device 210. Activation device 210 preferably comprises a wireless transmitter 210*c* for transmitting a wireless signal to switch 212 and a twist knob, toggle, slider, button, microphone, sensor, or another input component 210*b* that allows the operator of the tool to instruct that a wireless signal be transmitted. Wirelessly operated switch 212 likewise comprises a receiver for receiving the wireless signal from activation device 210. Activation device 210 may be worn by the operator of the tool such as with a lanyard 210*a* as shown in FIG. 2 or it may be handheld, attached to another device, or otherwise remotely located.

Optionally and preferably, a variable speed motor controller 306 is coupled between battery 40 and the motor of vibrator assembly 22 to facilitate electrical communication between the components. For non-wireless embodiments of device 10 that include a variable speed motor controller 306, switch 46 is a variable speed input such as a twist knob that communicates with the variable speed motor controller 306 the speed at which the motor of the vibrator assembly 22 should operate. For wireless embodiments of device 10 that include a variable speed motor controller 306, switch 212 is a variable speed input receiver that communicates with the variable speed motor controller 306 the speed at which the motor of the vibrator assembly 22 should operate and cooperating input component 210*b* is an input type such as a twist knob that accommodates variable inputs. Any type of input 44, 210*b* that allows for section among numerous options can be used, however.

FIG. 1 also illustrates how device housing 14 preferably cooperates with a first adaptor 48 to attach to the handle 60 of a concrete finishing tool. Adaptor 48 includes an adaptor extension 50 that is fixedly attached to and extending from a plate 56. Adaptor extension 50 is configured to fit within general chamber 20 of device housing 14 and can be a flange, a series of tabs, or another type of extension capable of fitting within and being attached to a housing. To secure adaptor 48 to device housing 14, fasteners such as set screws 52 extend through device housing 14 so that they engage adaptor extensions 50 when adaptor 48 is placed within chamber 14. First adaptor 48 also includes a tube 58 fixedly connected to plate 56 and extending in an opposite direction from extensions 50 as shown in FIG. 1. Preferably, extensions 50 and tube 58 are welded to plate 56. Tube 58 is intended to be attachable to or connected to the handle 60 of concrete finishing tool 12. As shown in FIG. 1, tube 58 further serves as a female end to device 10. Optionally, a set screw 62 can pass through handle 60 to engage tube 58 and thereby securely attach device 10 to handle 60 as shown in FIG. 2. Alternatively, tube 58 can removably attach to handle 60 with quick install fasteners such as a conventional spring loaded button on tube 58 that interacts with an opening in handle 60.

Similar to how first adaptor 48 engages handle 60, a second adaptor 64 connects device 10 to the terminus 66 of concrete finishing tool 12. Terminus 66 is shown as a float in FIG. 2. Second adaptor 54 includes an adaptor extension 66 that is fixedly attached to and extending from a support 80. Adaptor extension 66 is configured to fit within general chamber 20 of device housing 14 and can be a flange, a series of tabs, or another type of extension capable of fitting within and being attached to a housing. To secure second adaptor 64 to device housing 14, fasteners such as set screws 72 extend through device housing 14 so that they engage adaptor extensions 66 when adaptor 64 is placed within chamber 14. A hollow boss 74 is fixedly attached to adaptor extension 68 via support 80. Hollow boss 74 includes a tube 76 which extends outwardly from support 80 In a direction opposite from adaptor extension 68. Fasteners such as set screws 78 hold tube 76 within hollow boss 74. As shown in FIGS. 1 and 2, tube 76 serves as a male fitting and fits within a coupler 82 of concrete finishing tool terminus 66. Fasteners such as a set screw 84 connects and secures tube 76 to terminus 66 thereby holding device 10 to terminus 66. Alternatively, tube 76 can removably attach to terminus 66 with quick install fasteners such as a conventional spring loaded button on tube 76 that interacts with an opening in coupler 82 of terminus 66.

Figure 3:
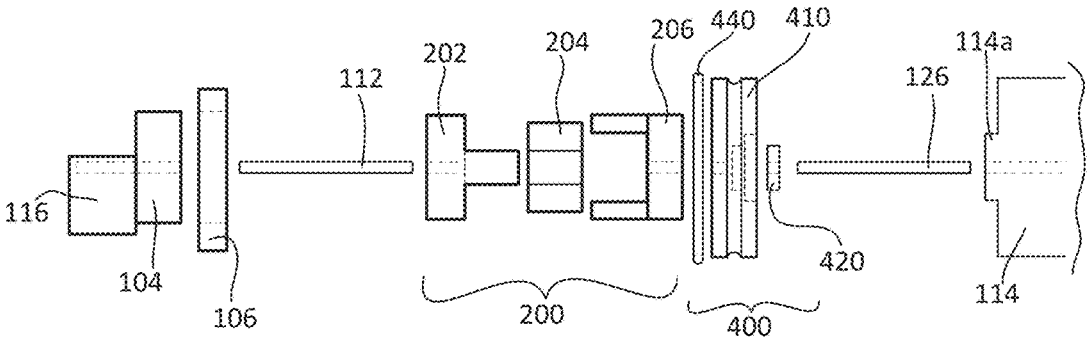
FIG. 3 is an exploded view of some vibrator components of the present invention.
Figure 4:
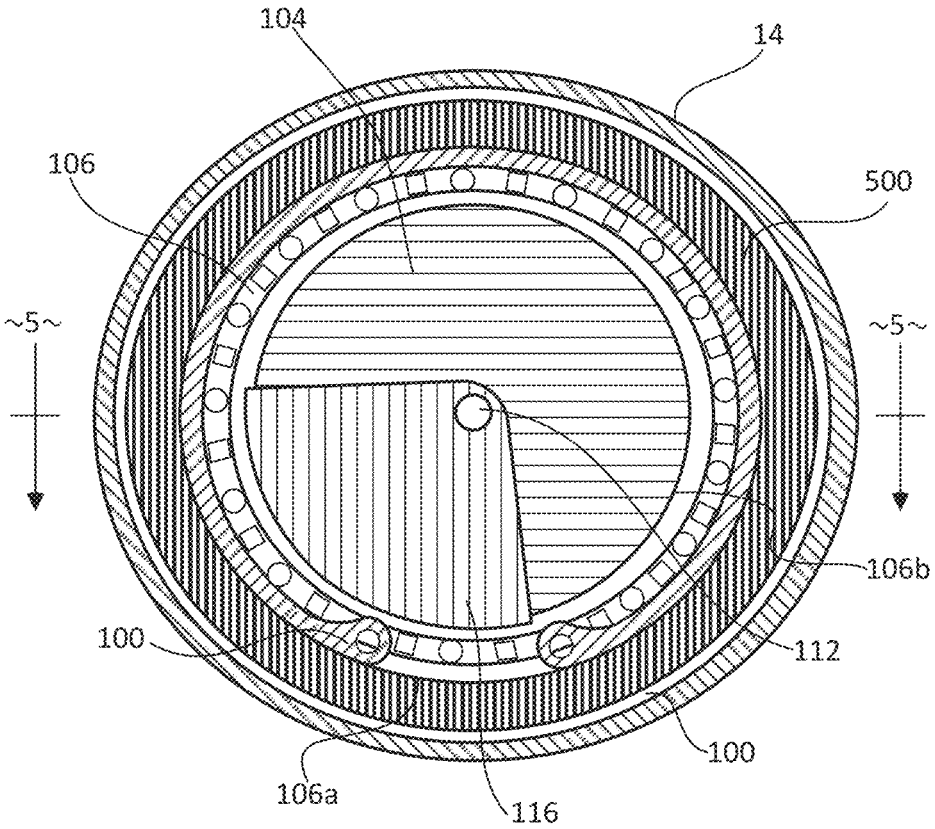
FIG. 4 is an end view of some vibrator components of the present invention.
Figure 5:
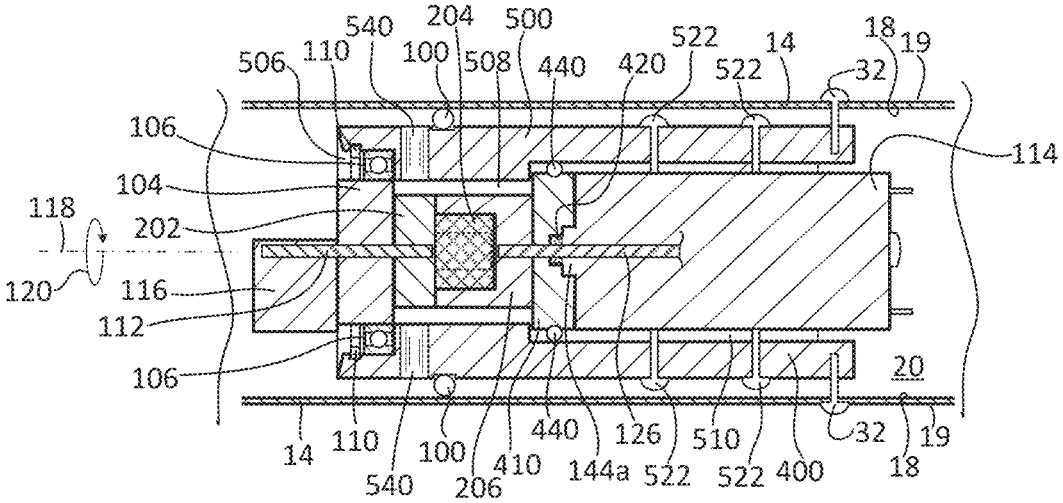
FIG. 5 is a sectional view of the vibrator components shown in FIG. 4 taken along line 5-5 of FIG. 4.
Figure 6:
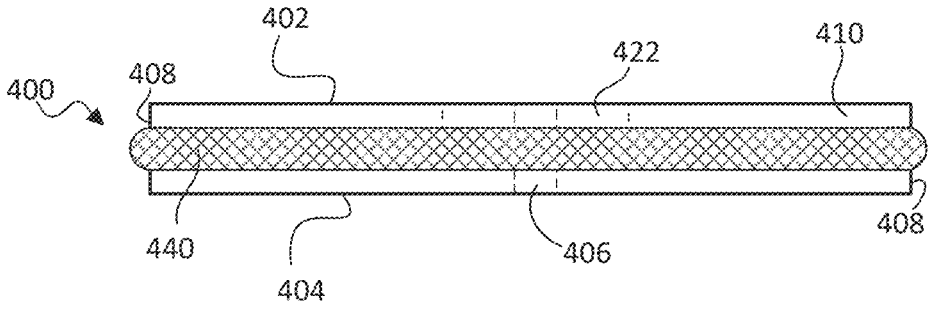
FIG. 6 is a side view of the double-seal spacer according to the preferred embodiment of the vibrator mechanism of the present invention.
Figure 7A:
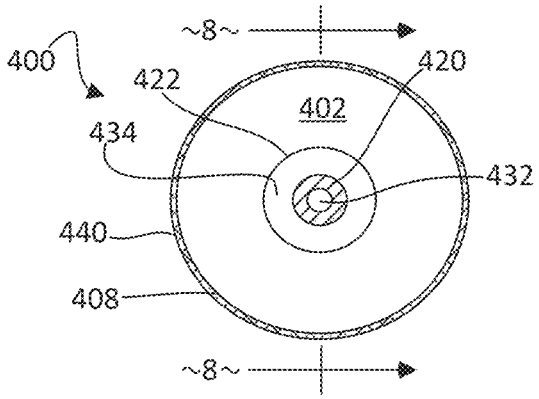
FIG. 7A is a first end view of the double-seal spacer of the vibrator mechanism according to the preferred embodiment of the present invention.
Figure 7B:
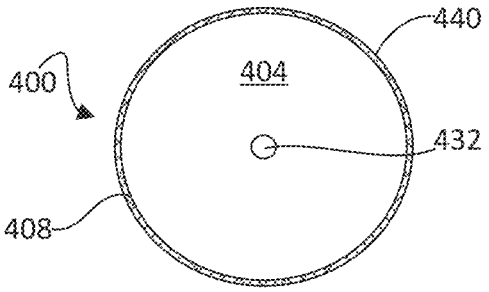
FIG. 7B is a second end view of the double-seal spacer of the vibrator mechanism according to the preferred embodiment of the present invention.
Figure 8:
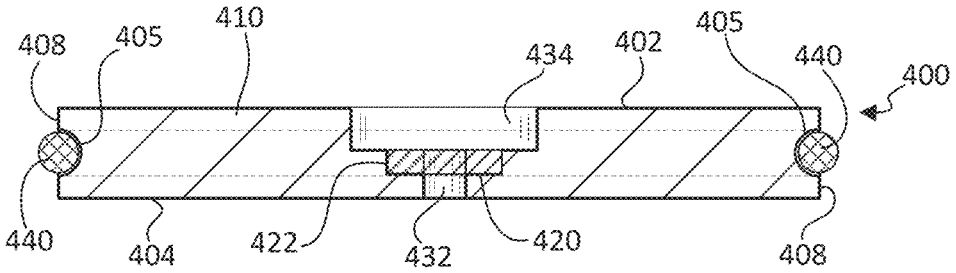
FIG. 8 is a sectional view of the double-seal spacer shown in FIGS. 6-7B taken along line 8-8 of FIG. 7A.
Figure 9:
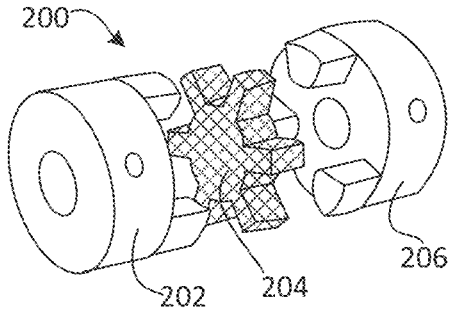
FIG. 9 is a perspective view of an alternate embodiment of the resilient link of the vibrator mechanism of the present invention.
Figure 10:
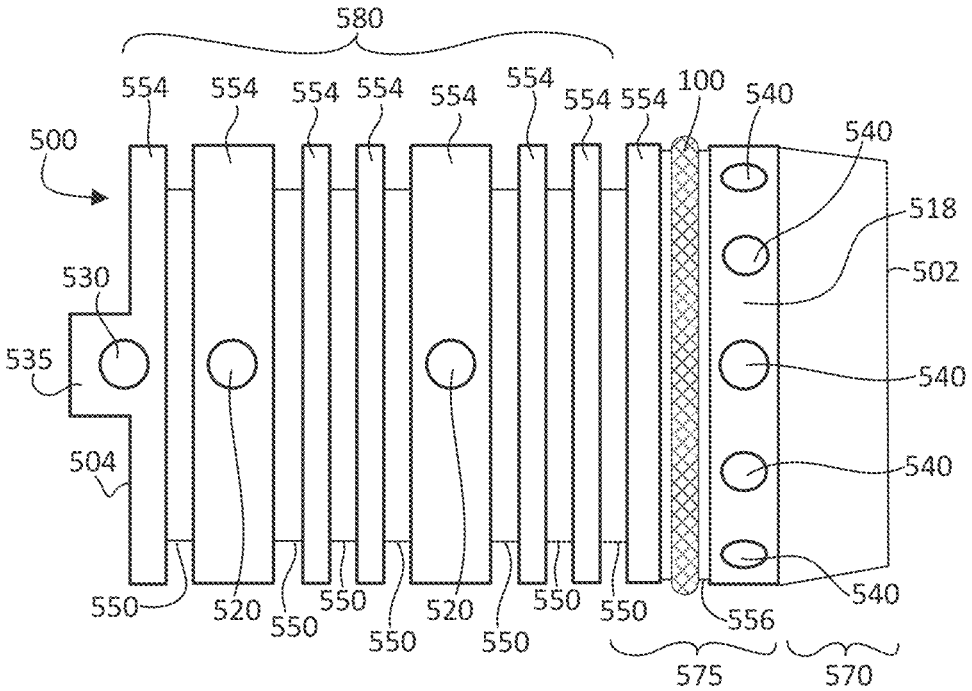
FIG. 10 is side view of the thermal decoupler housing according to a first embodiment of the present invention.
Figure 11:
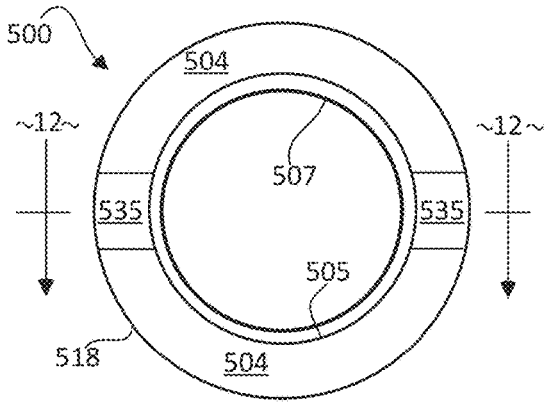
FIG. 11 is an end view of the thermal decoupler housing according to the first embodiment of the present invention.
Figure 12:
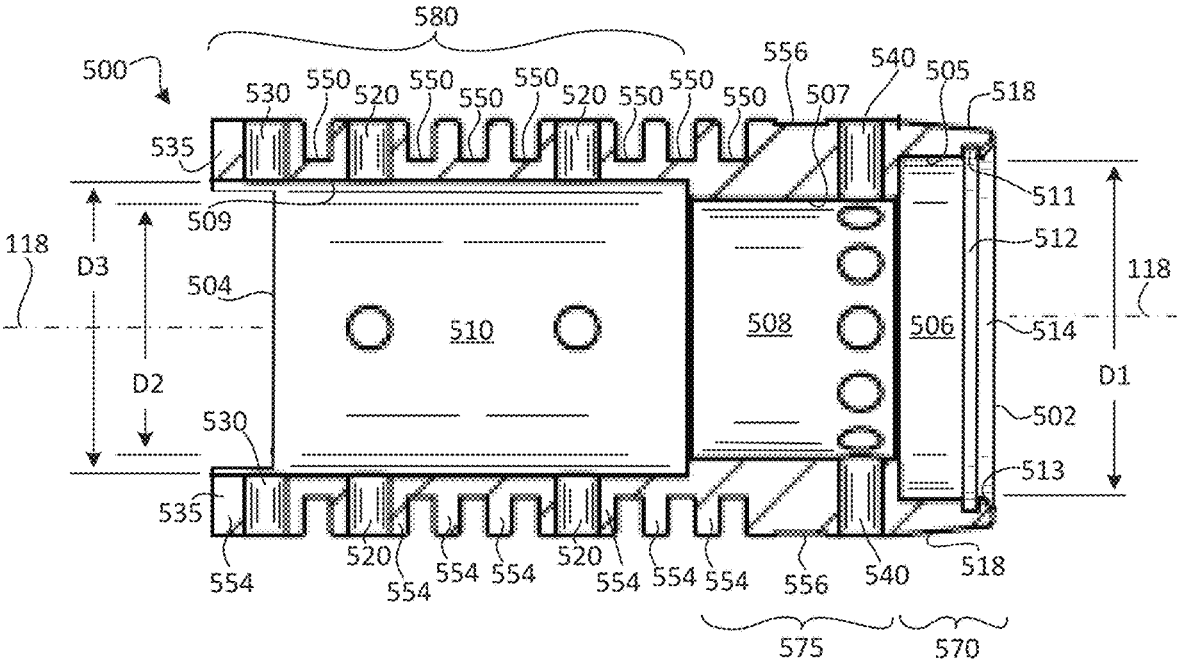
FIG. 12 is a sectional view of the embodiment shown in FIG. 11 taken along line 12-12 of FIG. 11.
Figure 13A:
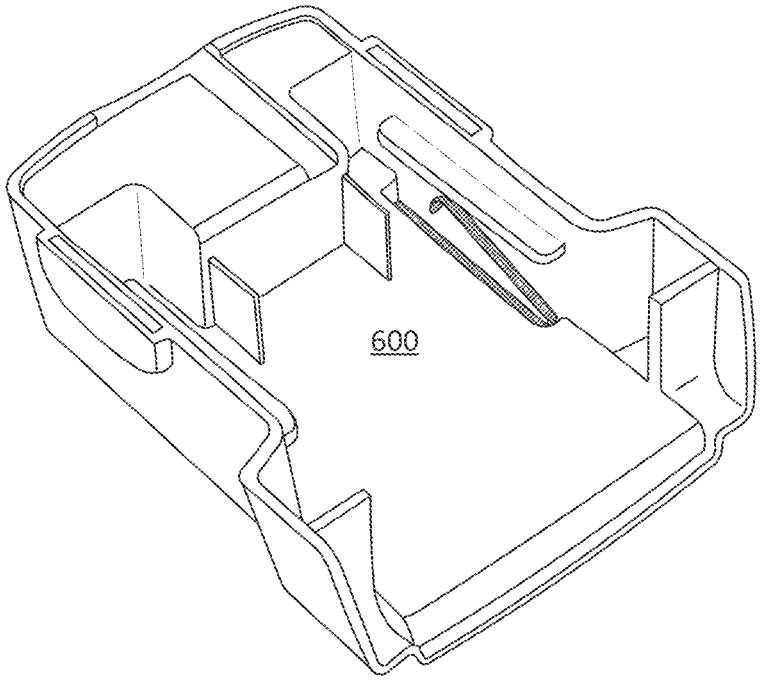
FIG. 13A is an illustration of a rail-style external battery useful with an alternate embodiment of the present invention.
Figure 13B:
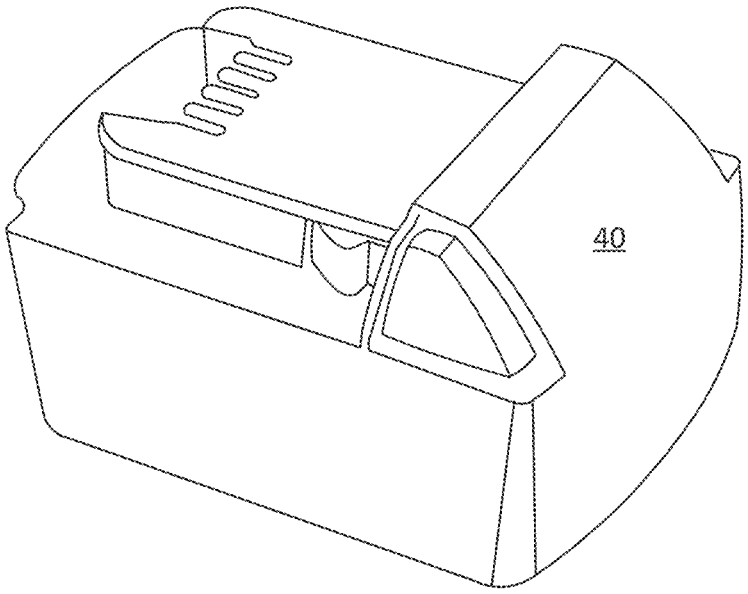
FIG. 13B is an illustration of the preferred embodiment of a battery receptacle for use with an external battery according to an alternate embodiment of the present invention.
Figure 14:
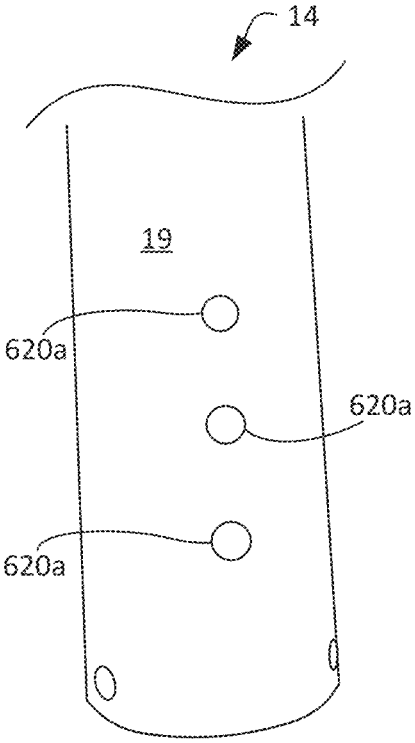
FIG. 14 is an illustration of the improved vibrator mechanism device housing adapted for use with an external battery according to an alternate embodiment of the present invention.
Figure 15A:
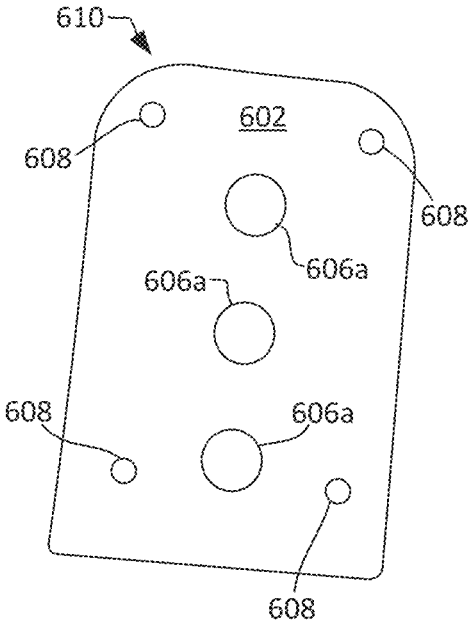
FIG. 15A is a first perspective view of the preferred embodiment of an adapter plate for use with an external battery according to the present invention.
Figure 15B:
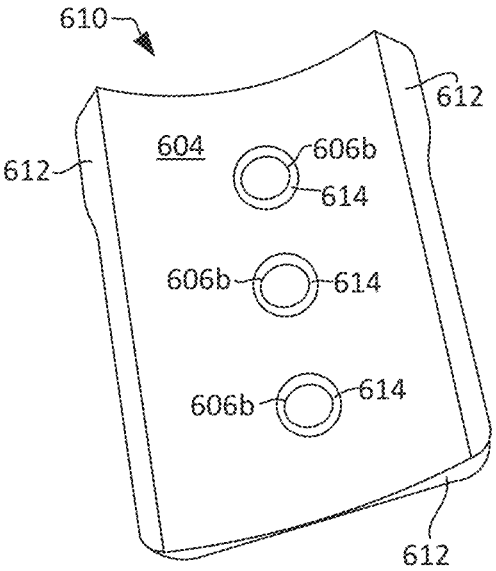
FIG. 15B is a second perspective view of the preferred embodiment of an adapter plate for use with an external battery according to the present invention.

Vibrator assembly 22, as shown in FIGS. 3-12 and 17-20, includes vibrator housing 500, which is also referred to herein as a thermal decoupler housing, that supports a resilient link 200 that connects on a first end 206, via a rotor shaft 112, to a combination spacer 400 and a motor 114 and connects on a second end 204, via a motor output shaft 126, to rotor 104 and connected or embedded weighted body 116, the rotor being surrounded by a roller bearing 106 and secured within the vibrator housing 500 by a spring clip 110. FIGS. 3-5 illustrate the arrangement of the vibrator components relative to one another, FIGS. 6-8 illustrate a preferred embodiment of the combination spacer 400, FIG. 9 illustrates an embodiment of the resilient link 200, FIGS. 10-12 illustrate a first embodiment of vibrator housing 500, and FIGS. 17-20 illustrate a preferred embodiment of vibrator housing 500.

Figure 17:
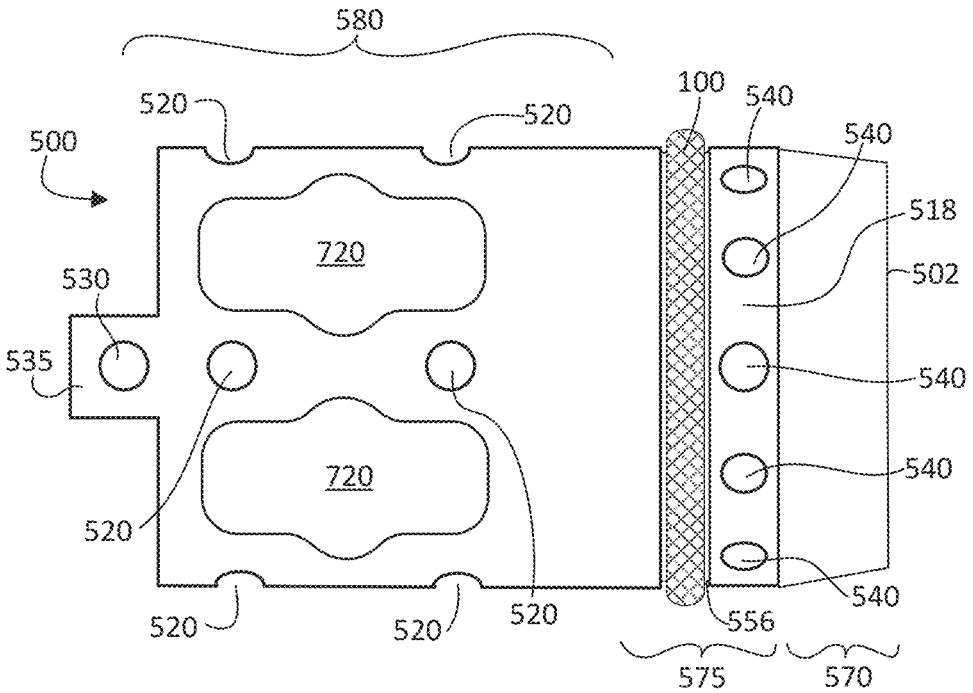
FIG. 17 is a side view of the thermal decoupler housing according to a second and preferred embodiment of the present invention where the perimeter vents have an irregular shape.
Figure 18:
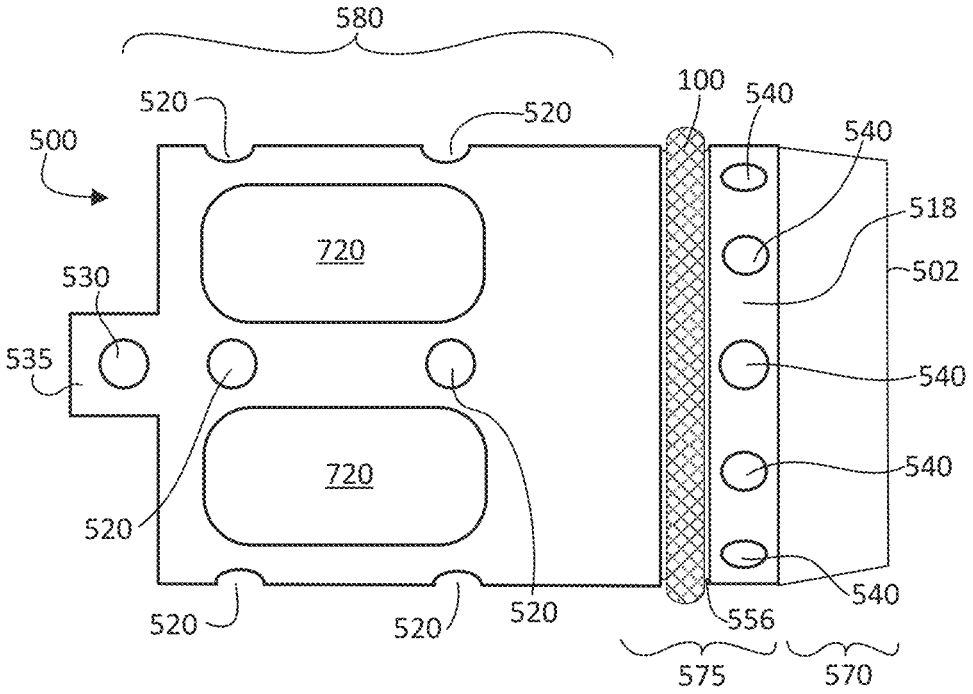
FIG. 18 is a side view of the thermal decoupler housing according to the second embodiment of the present invention where the perimeter vents have a rectangular shape with rounded corners.
Figure 19:
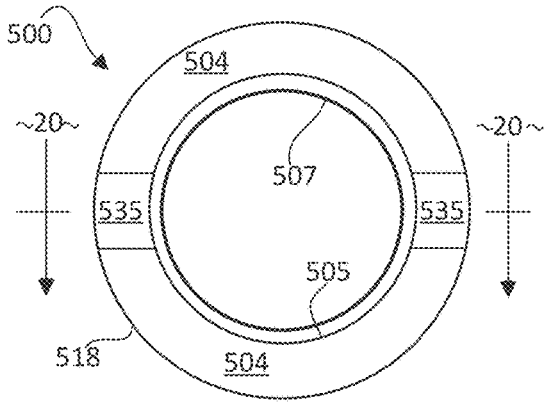
FIG. 19 is an end view of the thermal decoupler housing according to the second and preferred embodiment.
Figure 20:
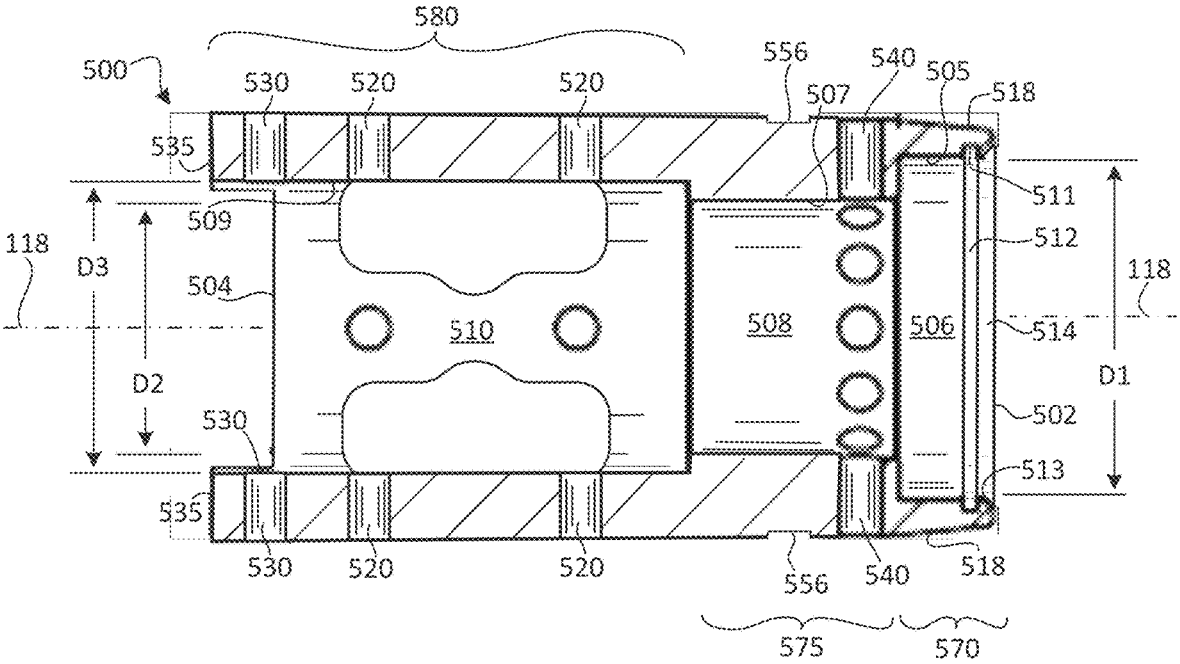
FIG. 20 is a sectional view of the embodiment shown in FIG. 19 taken along line 20-20 of FIG. 19.

Vibrator housing 500 has a first end 502, second end 504, and an outer surface 518. Vibrator housing 500 also defines a series of connected chambers, each configured to cooperate with a subset of the vibrator assembly components, which is described below in more detail. As shown in FIGS. 10-12, the outer surface 518 of the first embodiment of vibrator housing 500 alternates between annular body grooves 550 and annular fins 554 that promote heat transfer away from motor 114. Outer surface 518 of the first embodiment of vibrator housing 500 also defines an annular band groove 556 that accommodates resilient vibrator band 100, which is discussed above. As shown in FIGS. 17-20, the outer surface 718 of the second embodiment of vibrator housing 500 is substantially smooth, lacking the annular body grooves 550 and annular fins 554 of the first embodiment of vibrator housing 500. The second embodiment of vibrator housing 500 defines a series of windows or perimeter vents 720 spaced about the vibrator housing 500 perimeter and preferably spaced equally about its perimeter. The perimeter vents 720 extend from the outer surface 718 of the vibrator housing 500 to vibrator housing third chamber 510, which is described below. Perimeter vents 720 can be any shape including oval, square, rectangular, star, trapezoidal, or irregular, and preferably are sized larger than attachment openings 520. More preferably, perimeter vents 720 are positioned about the perimeter of housing 500, each one further positioned between sets or series of attachment openings 520 as shown in FIGS. 17-20 and configured with an irregular shape as shown in FIGS. 17 and 20. Both embodiments of vibrator housing 500 further define a series of cooling openings 540 spaced about its perimeter, preferably equally spaced, or circumference extending from its outer surface 518 to one of the interior chambers, a plurality of motor attachment openings 520 extending from its outer surface 518 to one of the interior chambers, and a plurality of spacer holes 530.

Near first end 502 of vibrator housing 500 is vibrator housing first chamber 506, which is surrounded by vibrator housing first inner surface 505. Vibrator housing first chamber 506 has a first diameter D1 and is preferably centered about vibrator housing 500's central axis 118 such that vibrator housing first chamber 506 has the same central axis 118 as shown on FIG. 5. More preferably, vibrator housing 500 and vibrator housing first chamber 506 further share a central axis with device housing 14. Vibrator housing first chamber 506 preferably includes a continuous circular groove 512 defined by vibrator housing first inner surface 505. Circular groove 512 is sized to accommodate spring clip 110 when the vibrator assembly 22 is assembled and first diameter D1 is sized to accommodate roller bearing 106. Optionally, vibrator housing first inner surface 505 includes a tapered section 514 between groove 512 and vibrator housing 500 first end 502 as shown in FIG. 12. The section of vibrator housing 500 where vibrator housing first chamber 506 is located is the vibrator housing rotor support section 570.

In fluid communication with and adjacent to vibrator housing first chamber 506 is vibrator housing second chamber 508. Vibrator housing second chamber 508 is surrounded by a vibrator housing second inner surface 507 and has a second diameter D2. Second diameter D2 is preferably smaller than first diameter D1 of vibrator housing first chamber 506. Vibrator housing second chamber 508 is also preferably centered about vibrator housing 500's central axis 118 such that vibrator housing second chamber 508 has the same central axis 118 as shown on FIG. 5. Cooling openings 540 extend from outer surface 518 of vibrator housing 500 into second chamber 508. The section of vibrator housing 500 where vibrator housing second chamber 508 is located is the vibrator housing resilient link section 575.

In fluid communication with and adjacent to vibrator housing second chamber 508 is vibrator housing third chamber 510. Vibrator housing third chamber 510 is surrounded by a vibrator housing third inner surface 509 and has a third diameter D3. Third diameter D3 is preferably larger than second diameter D2 of vibrator housing second chamber 508. Vibrator housing third chamber 510 is also preferably centered about vibrator housing 500's central axis 118 such that vibrator housing third chamber 510 has the same central axis 118 as shown on FIG. 5. The plurality of motor attachment openings 520 extend from the outer surface 518 of motor housing 500 into third chamber 510. The section of vibrator housing 500 where vibrator housing third chamber 510 is located is the vibrator housing motor section 580.

As shown in FIGS. 4-5, extending from first end 502 of vibrator housing 500 is weighted body 116, which is preferably embedded in or fixedly attached to rotor 104 such that it is offset from center in an eccentric manner. Rotor 104 rotatably fits within vibrator housing first chamber 506 due to roller bearing 106. Preferably, roller bearing 106 abuts first inner surface 505 at its outer surface 106*a* and attaches to rotor 104 at its inner surface 106*b*. Within vibrator housing first chamber 506, roller bearing 106 abuts first inner surface at some or all of the surface between groove 512 and a second housing chamber 508. Spring clip 110 is configured and sized to fit into groove 512 with an outward bias. When seated in groove 512, spring clip 100 secures roller bearing 106 and thereby rotor 104 in vibrator housing support section 570 of vibrator housing 500. Rotor 104 and optionally and preferably weighted body 116 optionally define channel configured to connect them to rotor shaft 112. In the preferred embodiment, however, shaft 112 is integral with rotor 104. Preferably rotor shaft 112 extends such that it is aligned with the central axis of rotor 104 and along one edge of weighted body 116. Rotor shaft 112 connects to or is integral with rotor 104 in such a manner that when rotor shaft 112 rotates, rotor 104 and weighted body 116 also rotate. FIG. 5 illustrates the alignment of rotor shaft 112 with rotor 104 and how they rotate 120 about central axis 118, which causes vibrations to occur.

Alternative embodiments of rotor 104 and weighted body 116 can be substituted for the preferred embodiment shown herein. For example, rotor 104 may define openings extending therethrough that serve as access points for operators to service components housed in vibrator housing 500. Weighted body 116 also can have a circular, conic, irregular, or other shape. Additionally, rotor shaft 112 can extend entirely through weighted body 116, partially through, or not at all. Weighted body 116 can be embedded in rotor 104 or attached via a press fit on top of a bushing (not shown) on shaft 112.

Rotor shaft 112 also connects with a first end 202 of resilient link 200 in such a way that when resilient link 200 rotates, rotor shaft 112 also rotates. Resilient link 200 also connects rotor shaft 112 with motor output shaft 126, which is connected to the second end 206 of resilient link 200 in such a way that when motor output shaft 126 rotates, resilient link 200 rotates. Resilient link 200 can be any type of resilient link such as a coil or spiral spring, coupler, or any other component capable of connecting two shafts in a resilient manner. Preferably, resilient link 200 is a coupler such as the one shown in FIG. 3, 5, or 9. In the preferred embodiment, first end 202 is a first coupling hub with one or more teeth (not labelled) that connects to shaft 112 of rotor 104, and second end 206 is a second coupling hub with one or more teeth (not labelled) that connects to shaft 126 of motor 114. A spider, star, spiral, or other elastomer insert 204 fits between and among the teeth of first end coupling hub 202 and second end coupling hub 206. The elastomer insert 204 connects the two shafts 112, 126 while protecting motor 114 from the vibration generated by rotor 104 and weighted body 116 when they rotate. Useful couplers include, for example, plum couplers, spider couplers, flexible shaft couplers, disc couplers, spiral couplers, and jaw couplers. Any resilient link that somewhat isolates motor 114 from rotating rotor 104, however, is acceptable.

Motor 144 connects to the second end 206 of resilient link 200 via motor output shaft 126. Motor 144 is positioned within vibrator housing third chamber 510 preferably held in place with set screws 522 or other fasteners positioned around its outer surface or perimeter. Set screws 522 preferably extend through openings 520 in vibrator housing at spaced intervals. More preferably, motor 144 is held within vibrator housing third chamber 510 with eight set screws 522.

In the preferred embodiment of vibrator assembly 22, motor 144 is isolated from resilient link 200, rotor 104, weighted body 116, and roller bearing 106 by a combination spacer 400 with a resilient spacer band 440. Combination spacer 400 is shown in detail in FIGS. 6-8 and in combination with other vibrator assembly 22 components in FIGS. 3 and 5. Combination spacer 400 includes a first spacer plate 410 and a micro motor shaft seal 420. First spacer plate 410 preferably includes an annular groove 405 around its outer wall 408 that is configured to cooperate with resilient spacer band 440, which is preferably an "O" ring. First spacer plate 410 also comprises a first surface 402 that is adjacent to, positioned near, or abuts motor 144 and a second surface 404 opposite first surface 402. Through the center of first spacer plate 410 is shaft bore 434 sized and configured to accommodate motor output shaft 126, a first pocket 422 sized and configured to accommodate micro motor shaft seal 420, and a second pocket 432 sized to fit over the nose 144*a* of motor 144. Motor output shaft 126 extends through motor nose 144*a* to facilitate its attachment to motor 144. For embodiments where motor 144 does not have a nose 144*a*, first space plate 410 need not have a second pocket 432. Together, micro motor shaft seal 420 and resilient spacer band 440 prevent or minimize oil from entering the vibrator housing third chamber 510 through the motor nose and shaft area and along the inner surfaces of vibrator housing 500. Additionally, oil is further contained by resilient vibrator band 100, which prevents or minimizes oil located in device housing 14 near the bearing from moving toward the motor 144, battery 40, switches, and other vulnerable components.

In operation, the user inserts device 10 between handle 60 and terminus 66 of concrete finishing tool, FIG. 4. Tube 58 of first adaptor 48 fits within hollow handle 60. Likewise, second adaptor 64 allows the connection of device 10 to terminus 66 of concrete finishing tool 10 by the use of a tube 76 which fits into hollow adaptor 84 of terminus 66. Set screws 62 and 84 connect adaptors 48 and 64 to handle 60 and terminus 66 of concrete finishing tool 12, respectively. Once device 10 is installed as shown in FIG. 2, the operator can activate the motor of the vibrator assembly by engaging the switch. Where available, the operator can also select the motor speed. Then, the operator moves the concrete finishing tool 12 along the surface 86 of soft concrete 88 to affect a desired finish on surface 86. For example, where concrete finishing tool is a float, as shown in FIG. 2, the improved vibrator assembly creates a smooth surface 86. Where desired, the operator can use the improved vibrator mechanism with other concrete finishing tools to produce a rough surface or to create grooves in concrete, as is the case with a jointer. With each use, vibrations originated from vibrator assembly 22 within device housing 14 are biased for transmission through adaptor 64 to concrete finishing tool 12 because of the arrangement and selection of components present. Moreover, the operator will enjoy the improved vibrator mechanism for additional uses during the mechanism's lifetime due to the newly added features that disperse heat and minimize or prevent oil from contaminating the motor.

While in the foregoing, embodiments of the present invention have been set forth in considerable detail for the purposes of making a complete disclosure of the invention, it may be apparent to those of skill in the art that many changes may be made in such detail without departing from the spirit and principles of the invention.

I claim:

1. A vibrator mechanism usable with a concrete finishing tool having a handle and a terminus, comprising:

a) a device housing, wherein the device housing defines a general chamber formed by an inner surface of the device housing;

b) a vibrator assembly positioned within the chamber of the device housing wherein the vibrator assembly comprises:

i) a vibrator housing comprising an outer surface, a first inner surface defining a first chamber, a second inner surface defining a second chamber, and a third inner surface defining a third inner chamber, the vibrator housing further defining a plurality of vents wherein each vent extends from the outer surface of the vibrator housing to the third inner surface of the vibrator housing and is positioned such that the third chamber of the vibrator housing is in fluid communication with the general chamber of the device housing;

ii) a rotor positioned at least partly in the first chamber of the vibrator housing and being adapted to turn relative to the vibrator housing, wherein the rotor comprises a rotor shaft extending outwardly from the rotor and a weighted body connected to the rotor;

iii) a motor positioned at least partly in the third chamber of the vibrator housing, wherein the motor comprises a nose end and an output shaft extending from the nose end of the motor;

iv) a combination spacer positioned in the third chamber near the nose end of the motor, the combination spacer comprising a spacer plate having an outer plate wall, a central plate bore, and a first plate surface positioned adjacent the nose end of the motor, a resilient spacer band at least partly surrounding the outer plate wall of the spacer plate, and a micro motor shaft seal defining a central shaft seal bore, wherein the micro motor shaft seal is positioned in a pocket defined by the first plate surface of the spacer plate, and the motor output shaft extends through the shaft seal bore of the micro motor shaft seal and the central plate bore of the spacer plate;

v) a resilient link positioned in the second chamber of the vibrator housing, wherein the resilient link connects the motor output shaft of the motor to the rotor shaft; and c) a resilient vibrator band at least partly surrounding the outer surface of the vibrator housing and contacting the inner surface of the device housing.

2. The mechanism of claim 1 further comprising a first adaptor configured to removably secure the device housing to the handle of the concrete finishing tool and a second adaptor configured to removable secure the device housing to the terminus of the concrete finishing tool.

3. The mechanism of claim 1 wherein the plurality of perimeter vents comprises first, second, third, and fourth perimeter vents equally spaced around the vibrator housing.

4. The mechanism of claim 3 wherein the vibrator housing extends to a length capable of housing a majority of the motor in the third chamber of the vibrator housing.

5. The mechanism of claim 1 wherein the vibrator assembly further comprises a bearing positioned in the first chamber of the vibrator housing between the first inner surface of the vibrator housing and the rotor.

6. The mechanism of claim 5 wherein the vibrator housing further defines a series of cooling openings extending from the outer surface of the vibrator housing to the second inner surface of the vibrator housing such that the second chamber of the vibrator housing is in fluid communication with the general chamber of the device housing.

7. The mechanism of claim 6 wherein the resilient vibrator band is positioned between the series of cooling openings and the end of the vibrator housing surrounding the motor.

8. The mechanism of claim 7 wherein the combination spacer is positioned in the third chamber of the vibrator housing such that it prevents fluid communication between the second and third chambers of the vibrator housing.

9. The mechanism of claim 1 further comprising an anchor positioned in the device housing and configured to hold the vibrator assembly within the general chamber of the device housing at a spaced relationship from the inner surface of the device housing.

10. The mechanism of claim 1 further comprising a bracket secured to an outer surface of the device housing and a battery receptacle secured to the bracket, wherein the battery receptacle is configured to accept a removable battery and to facilitate electrical communication between the removable battery and the motor of the vibrator assembly when the battery is secured in the battery receptacle.

11. The mechanism of claim 10 further comprising a switch positioned in the general chamber of the device housing, the switch being in electrical communication with the motor and with the battery when the battery is secured in the battery receptacle.

12. The mechanism of claim 11 wherein the switch is a remote-controlled switch that receives signals from a remote activation device and activates the motor of the vibrator assembly according to the signals received from the remote activation device.

13. The mechanism of claim 11 further comprising a variable speed controller positioned in the general chamber of the device housing and in electrical communication with the motor, the switch, and the battery when the battery is secured in the receptacle, wherein the switch comprises a variable speed input.

14. The mechanism of claim 13 wherein the variable speed input is remote controlled variable speed input that receives signals from a remote activation device and activates the motor according to the signals received from the remote activation device.

15. A vibrator mechanism usable with a concrete finishing tool having a handle and a terminus, comprising:

a) a device housing, wherein the device housing defines a general chamber formed by an inner surface of the device housing;

b) a vibrator assembly positioned within the general chamber of the device housing, wherein the vibrator assembly comprises:

i) a vibrator housing comprising an outer surface, a first end, a second end, a rotor section adjacent the first end of the vibrator housing, a motor section adjacent the second end of the vibrator housing, and a resilient link section positioned between the rotor section of the vibrator housing, the vibrator housing further defining a plurality of vents wherein each vent extends from the outer surface of the vibrator housing to the third inner surface of the vibrator housing and is positioned such that the third chamber of the vibrator housing is in fluid communication with the general chamber of the device housing;

ii) a rotor positioned at least partly in the rotor section of the vibrator housing and being adapted to turn relative to the vibrator housing, wherein the rotor comprises a shaft extending outwardly from the rotor and a weighted body connected to the rotor shaft;

iii) a roller bearing positioned in the rotor section of the vibrator housing, wherein the roller bearing at least partly surrounds the rotor;

iv) a motor positioned at least partly in the motor section of the vibrator housing, wherein the motor comprises a nose section and an output shaft extending from the nose section;

v) a combination spacer positioned in the motor section of the vibrator housing, wherein the combination spacer comprises a spacer plate having an outer wall and a first surface, a resilient spacer band at least partially surrounding the outer wall of the spacer plate, and a micro motor shaft seal disposed in a pocket defined by the first surface of the spacer plate, wherein the first surface of the spacer plate is oriented to be adjacent the nose section of the motor, and the output shaft of the motor extends through the spacer plate and micro motor shaft seal;

vi) a resilient link positioned in the resilient link section of the vibrator housing, wherein the resilient link connects the output shaft of the motor to the rotor shaft;

c) a resilient vibrator band at least partially surrounding the outer surface of the support of the vibrator and contacting the inner surface of the device housing;

d) an anchor positioned in the device housing and configured to hold the vibrator assembly within the general chamber at a spaced relationship from the inner surface of the device housing; and e) a remote controlled switch positioned in the general chamber of the device housing and in electrical communication with a battery and the motor, wherein the remote controlled switch receives signals from a remote activation device and activates the motor according to the signals received from the remote activation device.

16. The mechanism of claim 15 further comprising:

a) a first adaptor configured to removably secure the device housing to the handle of the concrete finishing tool; and b) a second adaptor configured to removable secure the device housing to the terminus of the concrete finishing tool.

17. The mechanism of claim 15 further comprising a variable speed controller in electrical communication with the battery, motor, and switch, wherein the switch comprises a variable speed input receiver and the activation device further comprises a remote variable speed input that remotely communicates with the variable speed input receiver.

18. The mechanism of claim 15 wherein the plurality of perimeter vents comprises first, second, third, and fourth perimeter vents equally spaced around the vibrator housing.

19. The mechanism of claim 15 wherein the resilient vibrator band is disposed in an annular groove defined by the outer surface of the vibrator housing in the resilient link section of the vibrator housing.

20. The mechanism of claim 19 wherein a series of cooling openings are disposed around the resilient link section of the vibrator housing between the first end of the vibrator housing and the resilient vibrator band, wherein the cooling openings facilitate fluid communication between a chamber defined by the resilient link section and the general chamber of the device housing.

* * * * *